US012121186B2

(12) United States Patent
Alishouse et al.

(10) Patent No.: US 12,121,186 B2
(45) Date of Patent: Oct. 22, 2024

(54) TOILET PAPER COVERING DEVICE

(71) Applicants: Kelly Alishouse, Aurora, CO (US); Scott Alishouse, Aurora, CO (US)

(72) Inventors: Kelly Alishouse, Aurora, CO (US); Scott Alishouse, Aurora, CO (US)

( * ) Notice: Subject to any disclaimer, the term of this patent is extended or adjusted under 35 U.S.C. 154(b) by 6 days.

(21) Appl. No.: 18/077,564

(22) Filed: Dec. 8, 2022

(65) Prior Publication Data

US 2024/0188764 A1 Jun. 13, 2024

(51) Int. Cl.
*A47K 10/34* (2006.01)

(52) U.S. Cl.
CPC ..... *A47K 10/34* (2013.01)

(58) Field of Classification Search
CPC ..... A47K 10/426; A47K 10/3836
See application file for complete search history.

(56) References Cited

U.S. PATENT DOCUMENTS 2,872,125 A * 2/1959 Rial ..... A47K 10/3836 242/597.7
3,561,836 A * 2/1971 Bennett et al. .... A47K 10/3836 312/34.22
4,179,078 A * 12/1979 Mansfield ..... A47K 10/38 312/215
5,058,792 A * 10/1991 Morand ..... A47K 10/3836 225/53
5,265,816 A * 11/1993 Collins ..... A47K 10/3836 242/560
5,454,500 A * 10/1995 Chen ..... A47K 10/38 225/46
5,538,170 A * 7/1996 Van Luit ..... B65H 35/002 225/53
5,833,169 A * 11/1998 Morand ..... A47K 10/38 242/596.4
5,996,931 A * 12/1999 Neveu ..... A47K 10/3836 242/423.1
7,275,708 B2 * 10/2007 Lewis ..... A47K 10/38 206/415
7,784,659 B2 * 8/2010 Bilotti ..... A47K 10/38 225/81
2004/0004153 A1 * 1/2004 Kapiloff ..... A47K 10/3836 242/597.8
2011/0248114 A1 * 10/2011 Ghetia ..... A47K 10/38 242/615
2021/0251438 A1 * 8/2021 Behramaj ..... B08B 1/143
2022/0192441 A1 * 6/2022 Bing ..... A47K 10/22
2023/0086343 A1 * 3/2023 Kurosaki ..... A47K 10/3836

* cited by examiner

*Primary Examiner* — William A. Rivera
(74) *Attorney, Agent, or Firm* — The Iwashko Law Firm, PLLC; Lev Ivan; Gabriel Iwashko

(57) ABSTRACT

A toilet paper covering device, including a base removably connected to at least a portion of an external surface, a roll rod angularly disposed away from the base with respect to a first direction to receive a roll of toilet paper thereon, a front wall angularly disposed away from the base with respect to the first direction to prevent access to the roll of toilet paper, and a rear wall angularly disposed away from the base with respect to the first direction to prevent access to the roll of toilet paper.

3 Claims, 2 Drawing Sheets

TOILET PAPER COVERING DEVICE

BACKGROUND

1. Field

The present general inventive concept relates generally to toilet paper holders, and particularly, to a toilet paper covering device.

2. Description of the Related Art

A pet owner will often have to handle unpleasant behaviors from a pet. In particular, a cat owner will experience a ruined bathroom due to destroyed toilet paper by a cat. Some cats enjoy playing with a roll of toilet paper, which can frustrate the cat owner due to wasted toilet paper that has been left on a bathroom floor and/or torn to pieces.

Accordingly, the pet owner will have to replace the roll of toilet paper and/or purchase new items. Also, the destroyed toilet paper can be embarrassing for the pet owner should a guest and/or a family encounter such a situation.

Therefore, there is a need for a toilet paper covering device to prevent access to the roll of toilet paper by the pet.

SUMMARY

The present general inventive concept provides a toilet paper covering device.

Additional features and utilities of the present general inventive concept will be set forth in part in the description which follows and, in part, will be obvious from the description, or may be learned by practice of the general inventive concept.

The foregoing and/or other features and utilities of the present general inventive concept may be achieved by providing a toilet paper covering device, including a base removably connected to at least a portion of an external surface, a roll rod angularly disposed away from the base with respect to a first direction to receive a roll of toilet paper thereon, a front wall angularly disposed away from the base with respect to the first direction to prevent access to the roll of toilet paper, and a rear wall angularly disposed away from the base with respect to the first direction to prevent access to the roll of toilet paper.

The front wall may include a lateral portion that is planar, and a curved portion disposed on at least a portion of the lateral portion to concavely curve away from the lateral portion.

The rear wall may be angularly disposed away from the lateral portion with respect to a second direction.

The toilet paper covering device may further include an extracting aperture disposed between the front wall and the rear wall to facilitate access to the roll of toilet paper therethrough.

BRIEF DESCRIPTION OF THE DRAWINGS

These and/or other features and utilities of the present generally inventive concept will become apparent and more readily appreciated from the following description of the embodiments, taken in conjunction with the accompanying drawings of which.

DETAILED DESCRIPTION

Various example embodiments (a.k.a., exemplary embodiments) will now be described more fully with reference to the accompanying drawings in which some example embodiments are illustrated. In the figures, the thicknesses of lines, layers and/or regions may be exaggerated for clarity.

Accordingly, while example embodiments are capable of various modifications and alternative forms, embodiments thereof are shown by way of example in the figures and will herein be described in detail. It should be understood, however, that there is no intent to limit example embodiments to the particular forms disclosed, but on the contrary, example embodiments are to cover all modifications, equivalents, and alternatives falling within the scope of the disclosure. Like numbers refer to like/similar elements throughout the detailed description.

It is understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present. Other words used to describe the relationship between elements should be interpreted in a like fashion (e.g., "between" versus "directly between," "adjacent" versus "directly adjacent," etc.).

The terminology used herein is for the purpose of describing particular embodiments only and is not intended to be limiting of example embodiments. As used herein, the singular forms "a," "an" and "the" are intended to include the plural forms as well, unless the context clearly indicates otherwise. It will be further understood that the terms "comprises," "comprising," "includes" and/or "including," when used herein, specify the presence of stated features, integers, steps, operations, elements and/or components, but do not preclude the presence or addition of one or more other features, integers, steps, operations, elements, components and/or groups thereof.

Unless otherwise defined, all terms (including technical and scientific terms) used herein have the same meaning as commonly understood by one of ordinary skill in the art to which example embodiments belong. It will be further understood that terms, e.g., those defined in commonly used dictionaries, should be interpreted as having a meaning that is consistent with their meaning in the context of the relevant art. However, should the present disclosure give a specific meaning to a term deviating from a meaning commonly understood by one of ordinary skill, this meaning is to be taken into account in the specific context this definition is given herein.

LIST OF COMPONENTS

Toilet Paper Covering Device 100
Base 110
Roll Rod 120
Front Wall 130
Lateral Portion 131
Curved Portion 132
Rear Wall 140
Extracting Aperture 150

Figure 1:
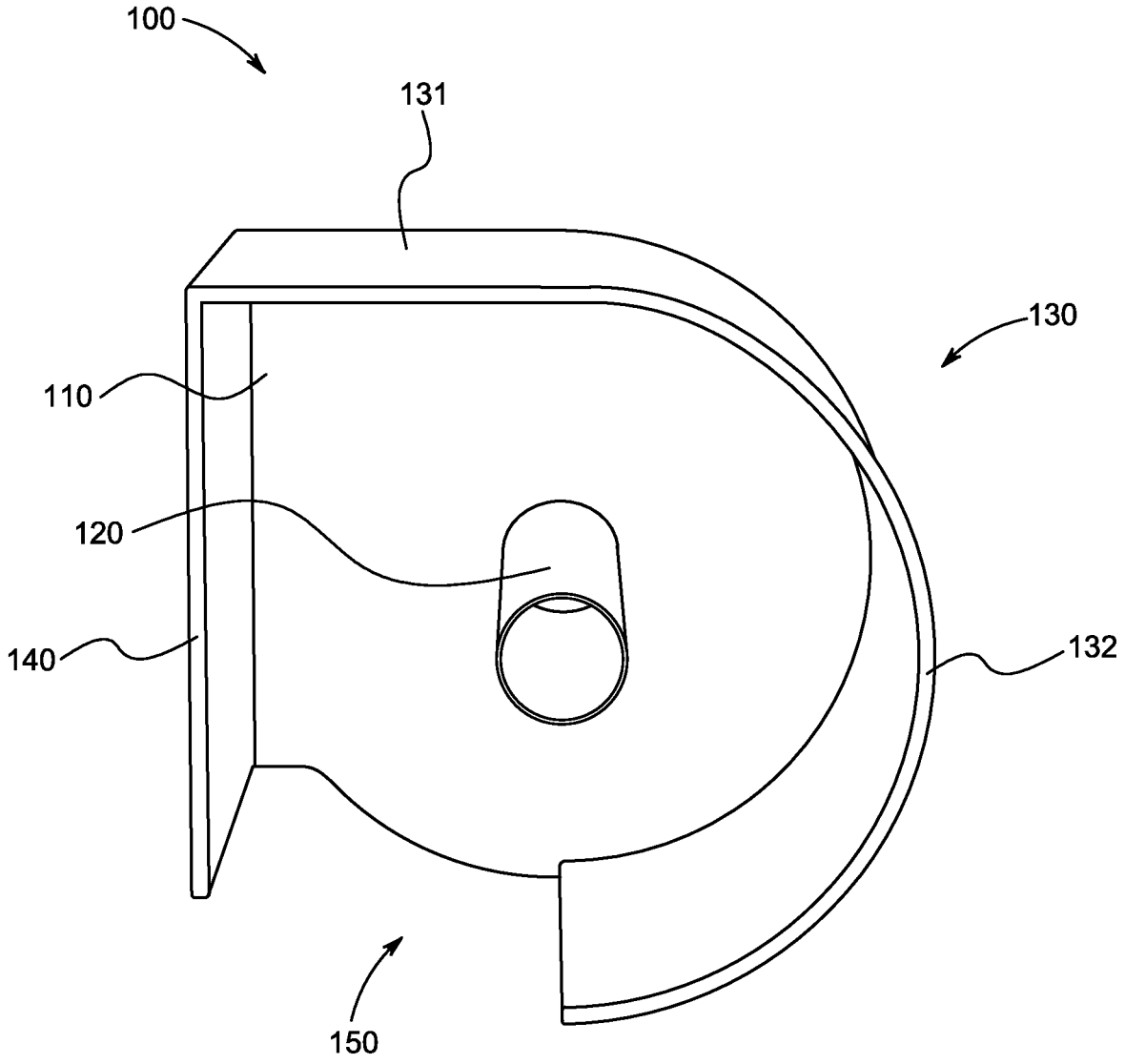
FIG. 1 illustrates a front side perspective view of a toilet paper covering device, according to an exemplary embodiment of the present general inventive concept.

FIG. 1 illustrates a front side perspective view of a toilet paper covering device 100, according to an exemplary embodiment of the present general inventive concept.

Figure 2:
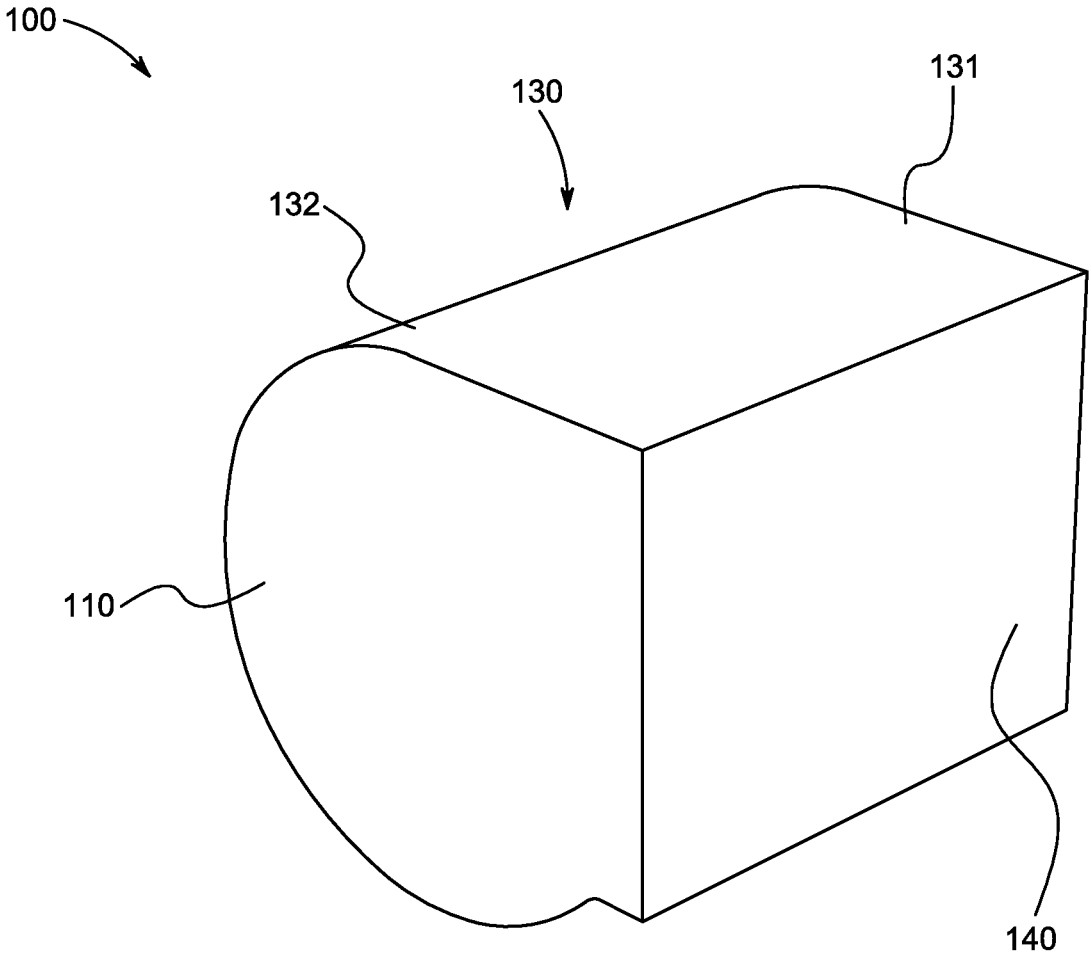
FIG. 2 illustrates a rear side perspective view of the toilet paper covering device, according to an exemplary embodiment of the present general inventive concept.

FIG. 2 illustrates a rear side perspective view of the toilet paper covering device 100, according to an exemplary embodiment of the present general inventive concept.

The toilet paper covering device 100 may be constructed from at least one of metal, plastic, wood, and rubber, etc., but is not limited thereto.

The toilet paper covering device 100 may include a base 110, a roll rod 120, a front wall 130, a rear wall 140, and an extracting aperture 150, but is not limited thereto.

The base 110 may be removably connected to at least a portion of an external surface (e.g., a wall, a cabinet). Moreover, the base 110 may be connected to the external surface without using tools (e.g., screwdriver, hammer, wrench, power tool) and/or fasteners (e.g., screws, nails, bolts). However, the base 100 may use adhesive (e.g., tape, glue) and/or magnets. In other words, the base 110 may be easy to attach and/or use.

Referring to FIG. 1, the roll rod 120 is illustrated to have a cylindrical shape. However, the roll rod 120 may be rectangular, triangular, pentagonal, hexagonal, heptagonal, octagonal, or any other shape known to one of ordinary skill in the art, but is not limited thereto.

The roll rod 120 may be angularly (e.g., perpendicularly) disposed away from the base 110 with respect to a first direction. The roll rod 120 may receive and/or store a roll of toilet paper thereon.

The front wall 130 may include a lateral portion 131 and a curved portion 132, but is not limited thereto.

The lateral portion 131 may be angularly (e.g., perpendicularly) disposed away from the base 110 with respect to the first direction. Also, the lateral portion 131 may be planar.

The curved portion 132 may be disposed on at least a portion of the lateral portion 131. Moreover, the curved portion 132 may curve away from the lateral portion 132, such that the curved portion 132 may be concave toward the base 110 (i.e., an interior surface). Conversely, the curved portion 132 may be convex on an outer surface thereof. The curved portion 132 may be based on a shape of the roll of toilet paper.

The rear wall 140 may be angularly (e.g., perpendicularly) disposed away from the base 110 with respect to the first direction. Also, the rear wall 140 may be angularly (e.g., perpendicularly) disposed away from the lateral portion 131 with respect to a second direction.

Collectively, and/or independently, the base 110, the front wall 130, and/or the rear wall 140 may prevent access to the roll of toilet paper. As such, the base 110, the front wall 130, and/or the rear wall 140 may prevent an animal (e.g., a cat) from destroying the roll of toilet paper.

The extracting aperture 150 may be disposed between the base 110, the front wall 130 and/or the rear wall 140. More specifically, the extracting aperture 150 may be a gap between the front wall 130 and/or the rear wall 140. Accordingly, the extracting aperture 150 may facilitate access to the roll of toilet paper 150 therethrough from a bottom portion. As such, the extracting aperture 150 may allow a user to reach therein to extract the roll of toilet paper.

Therefore, the toilet paper covering device 100 may protect the roll of toilet paper from the animal by preventing easy access to the roll of toilet paper by the animal. Also, the toilet paper covering device 100 may be easily mounted to an existing toilet paper holder without tools and/or construction.

The present general inventive concept may include a toilet paper covering device 100, including a base 110 removably connected to at least a portion of an external surface, a roll rod 120 angularly disposed away from the base 110 with respect to a first direction to receive a roll of toilet paper thereon, a front wall 130 angularly disposed away from the base 110 with respect to the first direction to prevent access to the roll of toilet paper, and a rear wall 140 angularly disposed away from the base 110 with respect to the first direction to prevent access to the roll of toilet paper.

The front wall 130 may include a lateral portion 131 that is planar, and a curved portion 132 disposed on at least a portion of the lateral portion 131 to concavely curve away from the lateral portion 131.

The rear wall 140 may be angularly disposed away from the lateral portion 131 with respect to a second direction.

The toilet paper covering device 100 may further include an extracting aperture 150 disposed between the front wall 130 and the rear wall 140 to facilitate access to the roll of toilet paper therethrough.

Although a few embodiments of the present general inventive concept have been shown and described, it will be appreciated by those skilled in the art that changes may be made in these embodiments without departing from the principles and spirit of the general inventive concept, the scope of which is defined in the appended claims and their equivalents.

The invention claimed is:

1. A toilet paper covering device, comprising: a base removably connected to at least a portion of an external surface;

a roll rod angularly disposed away from the base with respect to a first direction to receive a roll of toilet paper thereon;

a front wall angularly disposed away from the base with respect to the first direction to prevent access to the roll of toilet paper, wherein the front wall comprises:

a lateral portion that is planar, and a curved portion disposed on at least a portion of the lateral portion to concavely curve away from the lateral portion, such that the curved portion has a complete semicircular shape; and a rear wall angularly disposed away from the base with respect to the first direction to prevent access to the roll of toilet paper.

2. The toilet paper covering device of claim 1, wherein the rear wall is angularly disposed away from the lateral portion with respect to a second direction.

3. The toilet paper covering device of claim 1, further comprising:

an extracting aperture disposed between the front wall and the rear wall to facilitate access to the roll of toilet paper therethrough.

* * * * *